US008069863B2

(12) United States Patent
Bird

(10) Patent No.: US 8,069,863 B2
(45) Date of Patent: Dec. 6, 2011

(54) HAIRDRESSER'S MASKING AID

(75) Inventor: Raymond Bird, London (GB)

(73) Assignee: Raymond Bird (IP) Limited, Flax Bourton (GB)

( * ) Notice: Subject to any disclaimer, the term of this patent is extended or adjusted under 35 U.S.C. 154(b) by 247 days.

(21) Appl. No.: 12/303,969

(22) PCT Filed: Jun. 8, 2007

(86) PCT No.: PCT/GB2007/002133

§ 371 (c)(1),
(2), (4) Date: Feb. 3, 2009

(87) PCT Pub. No.: WO2007/141544

PCT Pub. Date: Dec. 13, 2007

(65) Prior Publication Data

US 2010/0018543 A1 Jan. 28, 2010

(30) Foreign Application Priority Data

Jun. 9, 2006 (GB) ..... 0611428.4

(51) Int. Cl.
*A45D 19/18* (2006.01)
*A45D 2/00* (2006.01)

(52) U.S. Cl. ..... 132/270; 132/222

(58) Field of Classification Search ..... 132/222, 132/270, 223; 206/245
See application file for complete search history.

(56) References Cited

U.S. PATENT DOCUMENTS

| | | | | |
|---|---|---|---|---|
| 1,893,352 | A * | 1/1933 | Backman | 132/222 |
| 1,929,042 | A * | 10/1933 | Stroher | 132/222 |
| 3,373,915 | A * | 3/1968 | Anderson et al. | 206/245 |
| 3,865,664 | A * | 2/1975 | Neumann | 156/192 |
| 5,056,539 | A | 10/1991 | Abramson | |
| 5,535,764 | A | 7/1996 | Abramson | |
| 5,549,126 | A | 8/1996 | Green | |
| 2002/0003157 | A1 | 1/2002 | Muir | |
| 2003/0111090 | A1 | 6/2003 | Lennon | |

FOREIGN PATENT DOCUMENTS

| | | |
|---|---|---|
| EP | 0122145 | 10/1984 |
| GB | 1489798 | 10/1977 |

(Continued)

OTHER PUBLICATIONS

International Search Report dated Jun. 8, 2010 for Serial No. EP 10003638.3, 7 pages.

International Search Report and Written Opinion, 13 pp., PCT No. PCT/GB2007/002133, Sep. 27, 2007.

International Search Report and Written Opinion, 4 pages, Great Britain Appln. Serial No. GB0611428.4, Aug. 23, 2006.

(Continued)

*Primary Examiner* — Robyn Doan

(74) *Attorney, Agent, or Firm* — Andrew F. Young, Esq.; Lackenbach Siegel, LLP

(57) ABSTRACT

A hairdresser's masking aid allows for masking selected strands of hair from other strands of hair while the selected strands are treated. The masking aid comprising at least two panels of flexible sheet material which are capable of being hinged apart to receive the selected strands and subsequently brought together to envelop the selected strands. At least one of the panels comprises a substrate of a flexible and transparent plastics material laminated over at least part of its area to a metal foil substrate. The plastics substrate is laminated to the said metal foil substrate by a laminating wax so that the resultant laminated sheet is capable of being deadfolded in a similar way as non-laminated aluminum foil.

25 Claims, 5 Drawing Sheets

FOREIGN PATENT DOCUMENTS

| | | | |
|---|---|---|---|
| GB | 2349816 | A | 11/2000 |
| GB | 2398493 | A | 8/2004 |
| JP | 9191922 | A | 7/1997 |
| WO | WO 91/18531 | | 12/1991 |

OTHER PUBLICATIONS

International Search Report and Written Opinion, 7 pages, Great Britain Appln. Serial No. GB0711053.9, Sep. 20, 2007.

* cited by examiner

HAIRDRESSER'S MASKING AID

CROSS REFERENCE TO RELATED APPLICATION

This application relates to and claims priority from Ser. No. PCT/GB2007/002133 filed Jun. 8, 2007, the entire contents of which are herein incorporated by reference; which in turn claims priority from GB Ser. No. 0611428.4 filed Jun. 9, 2006.

BACKGROUND OF THE INVENTION

1. Field of the Invention

The present invention relates to hairdresser's masking aids and in particular concerns masking sheets of the type that are adapted to engage and mask selected strands of hair while the selected strands are treated, for example, when performing a bleaching or a coloring process.

2. Description of the Related Art

A number of techniques are known that enable selected strands of hair to be treated and masked from unselected hair. For example, European patent number 0,122,145 discloses a hairdresser's masking sheet comprising a substrate of flexible material having an adhesive strip carried by the substrate for effecting attachments of the sheet to selected strands of a head of hair prior to treatment and for rapid removal of the strands from the substrate after treatment. The masking sheet comprises two rectangular panels, of substantially the same dimensions, which are welded together along a common edge to form a transversely extending hinge about which the panels are pivotal relative to one another. The hinged joint enables the panels to be hinged apart to receive the selected strands of hair between the panels and brought into proximity with each other to envelop the selected strands so that the strands may undergo a treatment process within the envelope so formed.

In one known example, the masking sheet comprises a first panel of opaque flexible sheet material, for example polyester, and a second panel of substantially transparent flexible sheet material welded to the first along a common edge. The transparent panel allows the hairdresser to monitor the progress of the coloring/bleaching process.

There are a number of drawbacks and disadvantages associated with hairdresser's masking sheets of the type described in EP 0122145. For example, the adhesive securing means (strip) becomes ineffective when brought into contact with many of the substances used to treat the selected hair. Consequently, the device tends to be labile, often slipping from the selected hair, thus requiring repositioning or replacement. Furthermore, the strips of adhesive material provide a barrier to treatment substances. Therefore, it is difficult to treat all of the selected hair within the envelope, particularly the roots of the selected strands that remain outside the envelope on the other side of the adhesive strip in use. Additionally, a problem experienced by hairdressers includes excessive application of treatment substances. For example, the application of too much treatment substance to the hair or to the interior of the envelope can lead to over processing of the selected strands, wastage of treatment substances and leakage of excess treatment solution from the envelope. The latter can be particularly problematic if excess treatment solution drips onto the clothing of the person undergoing the treatment process and causes bleaching or discoloration thereof. If too much treatment solution is applied and over processing occurs, the selected strands tend to tangle with neighboring strands when the treatment solution is washed out and the hair is dried.

This can lead to some of the selected strands breaking when subsequently combed. This problem arises from the fact that the hair cuticles become raised during over processing and the raised cuticles then interlock with the cuticles of neighboring strands, which causes tangling of the hair when it is dried.

Many hairdressers prefer to use strips of aluminum foil for masking strands of hair instead of using masking sheets of the aforementioned type. One of the preferred characteristics of metal foil is that it will dead fold to create a sealed region around the strands of hair being treated. Typically hairdresser's masking foil comprises strips of 18 micron aluminum foil. This thickness has been shown to provide sufficient strength for normal use and enables the hairdresser to reopen the packet or envelope formed by folding the foil to periodically monitor the coloration or bleaching process.

Metal foil is not, however, without its drawbacks. For example, a problem encountered by hair colorists and the like occurs when masking sheets of substantially opaque material, for example metal foil, are used to mask the selected strands of hair. Such opaque sheets do not readily enable the hair colorist to monitor the coloring or bleaching process without opening the envelope formed by the masking sheet around the selected strands of hair. This is an important consideration because as the hair grows out of the scalp it receives oxygen from the atmosphere and a hardening process known as keratinisation occurs. Keratinisation, or full keratinisation, takes about 6 weeks for normal hair, which is equivalent to about 25 mm (1 inch) growth. The first 25 mm of hair from the root is not, therefore, fully keratinised and more readily absorbs the active chemicals of the hair treatment substance used for colouring or bleaching. The remaining length of hair is fully keratinised and is hard and horn-like in texture. The greater hardness of the keratinised hair makes it much harder for the chemicals to penetrate the hair and this increases the amount of time required for the chemicals to be absorbed, which increases the process time. This is not necessarily a problem when highlighting selected strands by bleaching since the desired effect is to remove all pigment from root to tip and similarly where a whole head of hair is to be coloured darker than the hair's natural colour. However, the difference in processing times is significant when a whole head of hair is to be coloured lighter than the hair's natural colour and currently it is necessary for the hair colorist to first apply the treatment substance to the middle lengths and ends of the hair and wait for a predetermined amount of time, for example 20 minutes, before the same substance is applied to the roots in order to achieve even coloring. When using opaque masking sheets, such as metal foil, it is therefore, necessary for the hair colorist to periodically check that the roots have been processed sufficiently so that they are the same colour as the remaining keratinised part of the hair. As previously mentioned this involves the colorist periodically opening the envelope formed by the metal foil to observe the extent of the coloring process. In doing so, it is possible that treatment solution may escape.

ASPECTS AND SUMMARY OF THE INVENTION

In view of the above, the applicants have now recognized that there is a requirement, therefore, for an improved hairdresser's masking aid which readily enables hair technicians to monitor the coloration of hair being treated, particularly in the region of the non keratinised (or not fully keratinised) hair at the root adjacent to the scalp, without having to remove, or at least open, the metal foil comprising the masking sheet.

According to an aspect of the present invention there is provided a hairdresser's masking aid for masking selected strands of hair from other strands of hair while the selected strands are treated, the said masking aid comprising at least two panels of flexible sheet material which are capable of being hinged apart to receive the selected strands and subsequently brought together to envelop the selected strands, at least one of the panels comprising a substrate of a flexible and transparent plastics material laminated over at least part of its area to a metal foil substrate, the said plastics substrate being laminated to the said metal foil substrate by a laminating wax.

According to an aspect of the present invention there is provided a hairdresser's masking aid for masking selected strands of hair from other strands of hair while the selected strands are treated, the said masking aid comprising at least two panels of flexible sheet material which are capable of being hinged apart to receive the selected strands and subsequently brought together to envelop the selected strands, at least one of the panels comprising a substrate of a flexible and transparent plastics material laminated over at least part of its area to a metal foil substrate, the laminated plastics material substrate and metal foil substrate being capable of being dead folded.

The present invention combines the advantages associated with hairdresser's foil, namely the ability to dead fold the foil around the selected strands, with the ability to visibly monitor the bleaching or coloring process. The use of a laminating wax to join the metal foil substrate to the plastics substrate preserves the dead folding characteristics of the metal foil. When folded the laminated material does not unfold because as the material is folded the laminating wax cracks in the region of the fold and the deformed metal foil resists unfolding of the resilient plastics material. Metal foil laminated to plastics film using a normal chemical adhesive does not have this property as the adhesive forms a second intermediate resilient layer which in combination with the resilience of the plastics film is capable of overcoming the resistance of the metal foil to unfolding. Laminating metal foil to a substrate of flexible and transparent plastics material using a laminating wax therefore has particular advantages when used in the construction of a hairdresser's masking aid of the aforementioned type.

The laminating wax may comprise a mineral oil wax or a vegetable oil wax. In preferred embodiments the laminating wax comprises a mineral oil wax, preferably a paraffin wax. Vegetable oil laminating waxes exist but currently available vegetable oil waxes have an unpleasant smell unlike mineral oil which is more or less neutral in odor.

In preferred embodiments the metal foil substrate is laminated to the plastic substrate along the lateral sides of the laminated panel. In preferred embodiments the metal foil is provided in the form of a pair of elongate strips each of which extends along a respective side of the laminated sheet. The elongate strips are conveniently arranged to lie parallel with respect to each other on the laminated sheet. In this way it is possible to manufacture a web of sheet material comprising strips of metal foil wax laminated to a substrate of flexible plastics material. This is particularly convenient for large volume manufacture of hairdresser's masking aids of the present invention.

The region between the elongate strips preferably comprises at least one transparent region for viewing the selected strands during the bleaching or coloring process.

In preferred embodiments the region between the elongate strips comprises at least one opaque or semi-opaque region. The opaque or semi-opaque region(s) divide the non-laminated part of the sheet, that is to say the region between the elongate strips, to provide a plurality of separate windows in the sheet. This is particularly convenient in embodiments where it is desirable to have separate windows, for example a main central window and separate top edge and bottom edge windows. A top edge window is particularly suitable for monitoring the bleaching or coloring process in the region of the roots of the hair being treated and a window in the region of the bottom edge is suitable for monitoring the quantity of any excess treatment substances contained within the masking aid in use.

In preferred embodiments the opaque or semi-opaque regions are printed on the plastics substrate. In this way it is possible to provide separate windows in the non-laminated region of the sheet. Separate windows could of course be provided by using a die-cut metal foil substrate instead of elongate strips and printed regions between the strips in the non-laminated area of the sheet. Although it would be possible to create separate windows in this way it is considerably more preferable to use continuous strips of metal foil substrate than die-cut foil during the process of laminating the metal substrate to the plastics substrate.

In preferred embodiments the opaque or semi-opaque region(s) is/are printed on the plastic substrate using ink. The printed regions may be printed using any known printing process including, for example gravure printing etc.

In preferred embodiments the metal foil substrate comprises aluminum foil. In preferred embodiments the metal foil substrate has a thickness of 18 micron or thereabouts and the thickness of the plastics substrate is 12 micron such that the overall thickness of the laminate is 30 micron or thereabouts. However, the invention contemplates embodiments where the respective thickness of the metal and plastic substrates is in the range 10 to 20 micron. It is understood that a plastics material substrate having a thickness of 6 micron or less would be unsuitable for manufacturing due to the strength of the substrate material. Plastics material substrates greater than 12 micron are less suitable for this particular application (hairdresser's masking aids) because of the additional weight associated with the thicker material in addition to the increased resilience of the thicker sheet.

Suitable plastics materials for the plastics substrate include PET, HDPE and polyester. Polyester has good strength properties in that it is tear resistant. Polyester is also chemical resistant.

In preferred embodiments the laminating wax has a thickness equivalent to a print density in the range 0.6 to 2.2 grams per square meter (gsm), more preferably 0.12 to 0.16 gsm.

In another preferred embodiment of the present invention only the front panel of the masking aid comprises a laminated sheet of a substrate of a flexible and transparent plastics material laminated to metal foil substrate by a laminating wax. The front panel is joined to a rear panel of the masking aid, preferably by an adhesive. Preferably the adhesive is applied over an extended area at one end of the respective panels to provide a bottom edge seal about which the panels may be hinged apart (i.e. opened).

Preferably the bottom edge seal is defined in such a way that not only is the bottom edge of the masking aid sealed but the lateral sides of the front and rear panels in the region of the bottom edge are also sealed. The actual shape and size of the excess product reservoir so formed by the bottom edge seal is preferably defined by the distribution of adhesive between the front and rear panels joining the panels together.

In preferred embodiments the rear panel comprises a sheet of metal foil, preferably aluminum foil and preferably aluminum foil having a thickness in the range of 12 to 24 microns (μm), more preferably in the range 18 to 20 microns and most preferably 18 microns. 18 micron aluminum foil is currently the thickness of aluminum foil used by hairdresser's and by using 18 micron aluminum foil for the rear panel it is possible to achieve the same weight and feel of the foil in the masking aid of the present invention.

Preferably the rear panel has a top edge portion having a stiffness greater than the majority of the remaining part of the rear panel. It is preferred that the rear panel is reinforced in this way along the region of its top edge for improved handling and manipulation of the masking aid by the hairdresser in use.

The stiffened top edge portion may comprise multiple layers of the rear panel sheet material; preferably the stiffened top edge comprises a triple thickness portion. For ease and convenience of manufacture it is preferred that the three layers are produced by introducing a Z-fold into the sheet material during manufacture. The adjoining faces of the Z-fold maybe provided with adhesive so that the adjacent layers of the Z-fold are firmly and securely held together.

At least part of the top edge portion may be embossed; preferably the majority of the stiffened top edge portion is embossed. The embossed top edge provides for further stiffening of the top edge region where it is embossed and also provides this part of the rear panel with capillary-like channels for enabling the flow of treatment solution from the interior of the masking aid towards the top edge thereof to ensure even distribution of the treatment solution to the root portions of the hair being treated in use.

The embossing may be in the form of a plurality of parallel lines which extend in a direction perpendicular to the top edge of the panel. It is envisaged that such an embossed pattern will provide discrete capillary channels for conducting treatment solution towards the top edge of the masking aid.

Preferably there is provided a non-embossed region at the extremity of the top edge of the panel between the top edge and the embossed region. In preferred embodiments the non-embossed region has a depth of between 1.0 and 3.0 mm from the top edge of the rear panel, in preferred embodiments the depth of the non-embossed region is 2.0 mm or thereabouts. The embossed region may have a depth of 15-25 mm, but in preferred embodiments a depth of 18-20 mm.

The above, and other aspects, features and advantages of the present invention will become apparent from the following description read in conduction with the accompanying drawings, in which like reference numerals designate the same elements.

BRIEF DESCRIPTION OF THE DRAWINGS

Various embodiments of the present invention may have been more particularly described by way of example only, reference to the accompanying drawings, in which.

DETAILED DESCRIPTION OF THE PREFERRED EMBODIMENTS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. 112, paragraph 6 to define the invention. To the contrary, if the provisions of 35 U.S.C. 112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. 112, paragraph 6. Moreover, even if the provisions of 35 U.S.C. 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

Figure 1:
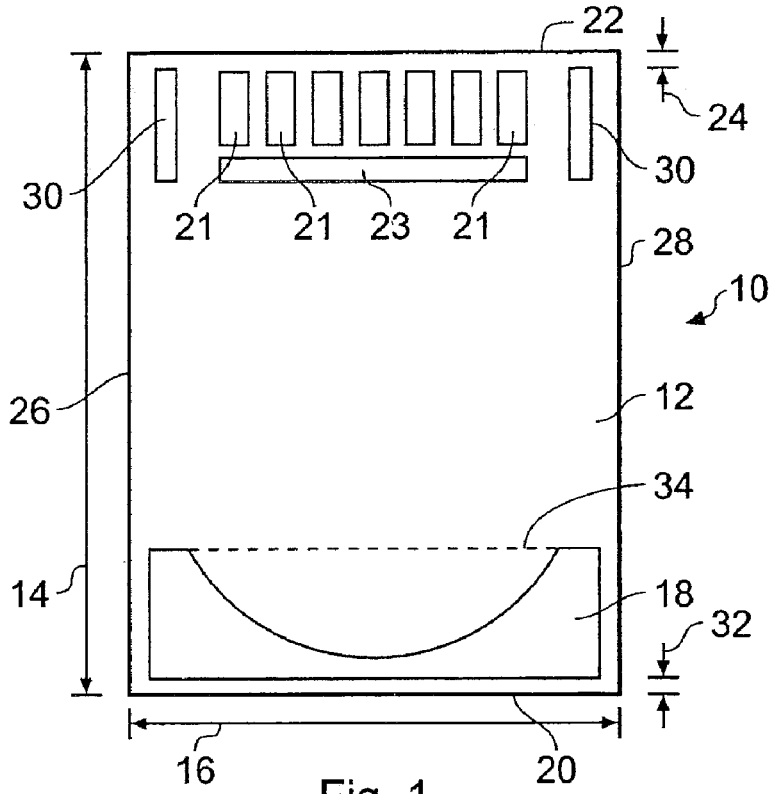
FIG. 1 is a plan view of a rear panel for a hairdresser's masking aid according to an embodiment of the invention.

Referring now to FIG. 1, a rear panel 10 of hairdresser's masking aid according to an embodiment of a present invention comprises a rectangular sheet of aluminum foil 12. In one embodiment the foil sheet 12 has a length dimension 14 of approximately 120 mm and a width dimension 16 of 90 mm. The upward facing surface of the foil sheet, shown in the drawing of FIG. 1, is provided with various adhesive regions including an adhesive strip 18 in proximity to the lower edge 20 of the sheet and a plurality of rectangular spaced adhesive islands 21 in proximity to the upper edge 22. The adhesive islands 21 extend from one side of the sheet to the other and are arranged side by side in a one dimensional array type arrangement. A gap 24 of approximately 3 mm or so is provided between the top edge 22 of the sheet and the adhesive islands 21 so that the adhesive does not interfere with cutting of the aluminum sheet once the adhesive has been applied on the sheet during manufacture. The first and last adhesive islands 21 in the array are spaced from the respective side edges 26 and 28 of the sheet by about 15 mm or so to provide room for elongate adhesive side strips 30 positioned adjacent the respective side edges 26 and 28. A gap of about 3 mm is provided between the respective islands. An additional adhesive security strip 23 is provided just below the adhesive islands 21, that is to say on the side of the islands facing the bottom edge 20. The adhesive strip has a length dimension of approximately 60 mm and a width dimension of approximately 4 mm. The strip 23 is spaced from the islands 21 by approximately 3 mm or so.

The adhesive strips 30 are spaced from the respective side edges 26 and 28 by about 3 mm or so to aid cutting of the aluminum sheet 20 during manufacture. The adhesive strips comprise a dot matrix array of adhesive spots for ease of peeling the front sheet from the back sheet when the masking aid is prepared for use. The dot matrix adhesive arrangement desirably lessens the distortion of the front sheet, due to stretching, when it is peeled away from the adhesive strips 30 in readiness for use. The strips 30 have a width dimension of approximately 4 mm and a length dimension of approximately 18 mm.

The adhesive islands 21 function, in use, to secure the masking aid to the selected strands of hair to be treated. The regions between the islands provide liquid conducting channels so that treatment solution may flow over the region defined by the islands towards the top edge 22 of the sheet.

The side strips 30 in combination with the bottom edge adhesive strip 18 secure the rear panel 12 to the front panel as will be further described below.

The adhesive strip 18 is in the form of a rectangular strip with a part circular portion removed from the side facing the islands 21 to provide an inverted arch shape adhesive area which has a maximum width dimension in the region of the respective side edges 26 and 28 and a minimum width section mid-way between the side edges. A non-adhesive border region 32 having a width dimension of about 3 mm is provided between the adhesive strip 18, the lower edge 20 and the respective side edges 26 and 28. This border ensures that the adhesive is spaced from the cutting tools when the sheet 12 is cut from a web of such sheets during manufacture.

The width dimension of the strip 18 remains constant in the region of the respective edges 26 and 28 before it reduces to a minimum at a mid point between the sides. As will be appreciated later in the description this enables the front sheet to pivot relative to the rear panel along a hinge line 34 defined by the wider parts of the strip 18 on the side of the strip facing the islands 21. The hinge line 4 defined by the strip 18 is spaced approximately 30 mm from the bottom edge 20. Thus the strip 18 has a width dimension of about 27 mm in the region of the side edges 26 and 28 of the sheet. This reduces to a width dimension of approximately 8 mm at its minimum width at the mid point.

Figure 2:
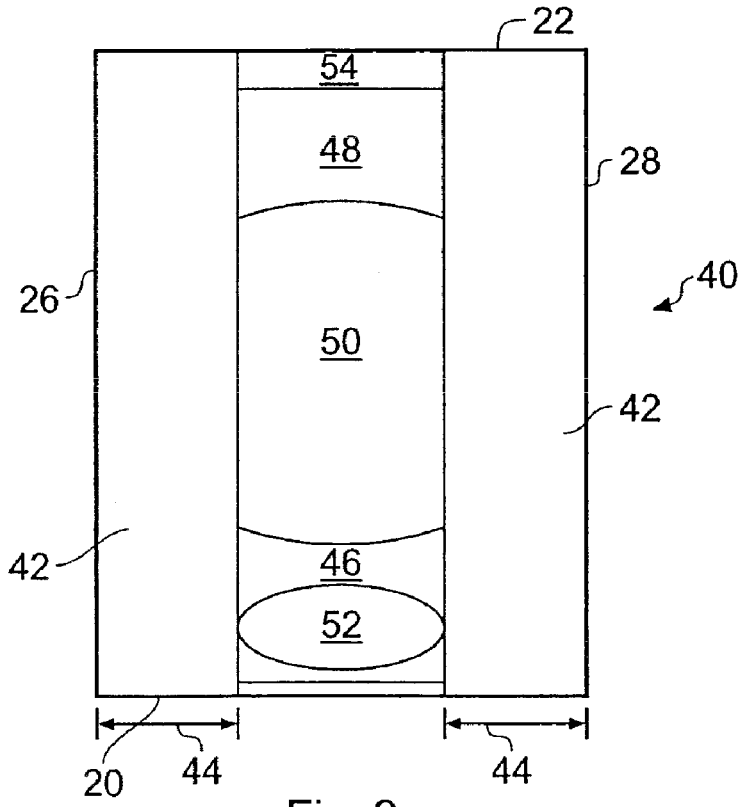
FIG. 2 is a plan view of a front panel for a masking aid having a rear panel shown in FIG. 1.

Referring now to FIG. 2, the front panel 40 of the masking sheet of the illustrated embodiment comprises a substrate of transparent flexible plastics material laminated over at least part of its area to a metal foil substrate by a laminating wax. The front panel 40 has the same width and length dimensions as the rear panel, that is to say the transparent plastics substrate has the same width and length dimensions as the rear panel with the metal foil substrate applied to the plastics substrate along the lateral side regions of the panel as elongate parallel strips 42. Each of the metal foil strips 42 extends the full length of the panel between the top edge 22 and the bottom edge 20 with each having a width dimension 44 of about 25 mm or so such that the region between the strips has a width dimension of about 40 mm or so.

The metal foil substrate is laminated to the clear plastics substrate using a laminating wax such as a paraffin type mineral wax. An example of a suitable laminating wax is available under the trade name SAF Nowax (RTM). The unlaminated region in the centre of the panel between the strips 42 is divided into separate regions by covering or coating the transparent plastics substrate in the region of the bottom edge of the panel, indicated at 46, and in the region of the top edge of the panel, indicated at 48. In the illustrated embodiment the plastics substrate is printed to provide opaque or semi-opaque regions 48 and 46 between the foil strips 42 to provide three separate transparent window regions 50, 52 and 54 in the central portion of the front panel. The main window region 50 in the centre of the panel has a length dimension of approximately 60 mm between the opaque region 48 and the opaque region 46 and comprises the main window through which the hairdresser, stylist or coloring technician can view the coloration or bleaching process taking place on the selected strands when in use. The top edge window 54 has a length dimension of about 5 or 6 mm between the opaque region 48 and the top edge 42 of the front panel. The lower edge window 52 is defined by an oval-shaped region within the opaque region 46 adjacent to the lower edge 20. The lower edge window 52 is spaced from the lower edge 20 of the front panel by about 7 mm or so.

In another embodiment the adhesive strip 18 may be applied additionally or alternatively to the rear surface of the front sheet 40 for adhesive contact with the rear sheet over the area 18 indicated for the adhesive strip 18 in FIG. 1.

It will be understood that the rear panel and front panel are manufactured using respective webs of material and in the case of the front panel the web may comprise a 500 mm width of a plastics substrate, for example polyester, PET or HDPE on which is printed the opaque regions 46 and 48 using conventional printing techniques and laminated with metal foil strips 42 to provide the finished web before cutting into appropriate size panels for joining to respective rear panels 12 as previously described in FIG. 1. With a 500 mm width web it is possible to print and laminate 5 front panels side by side such that the web of plastics substrate is laminated with 50 mm width metallic foil to provide the foil side strips 42 of adjacent panels on the web. Rolls of 500 mm width web may then be loaded on conventional rolling and cutting machinery for joining to rear panels 10.

As previously described the purpose of the adhesive strip 18 and adhesive islands 21 is different since the adhesive strip 18 is used to join the front and rear panels together and provide a bottom edge seal while the purpose of the adhesive islands and additional strip 23 is to stick the masking aid to the selected strands of hair. In this respect it is preferable that the adhesive used for the adhesive islands is less chemical resistant than the adhesive used for the adhesive strip 18, particularly since the bottom edge seal provided by the adhesive strip 18 is necessary to provide a chemical resistant seal to prevent chemical degradation of the seal by the hair treatment products applied to the selected strands in use.

Figure 3:
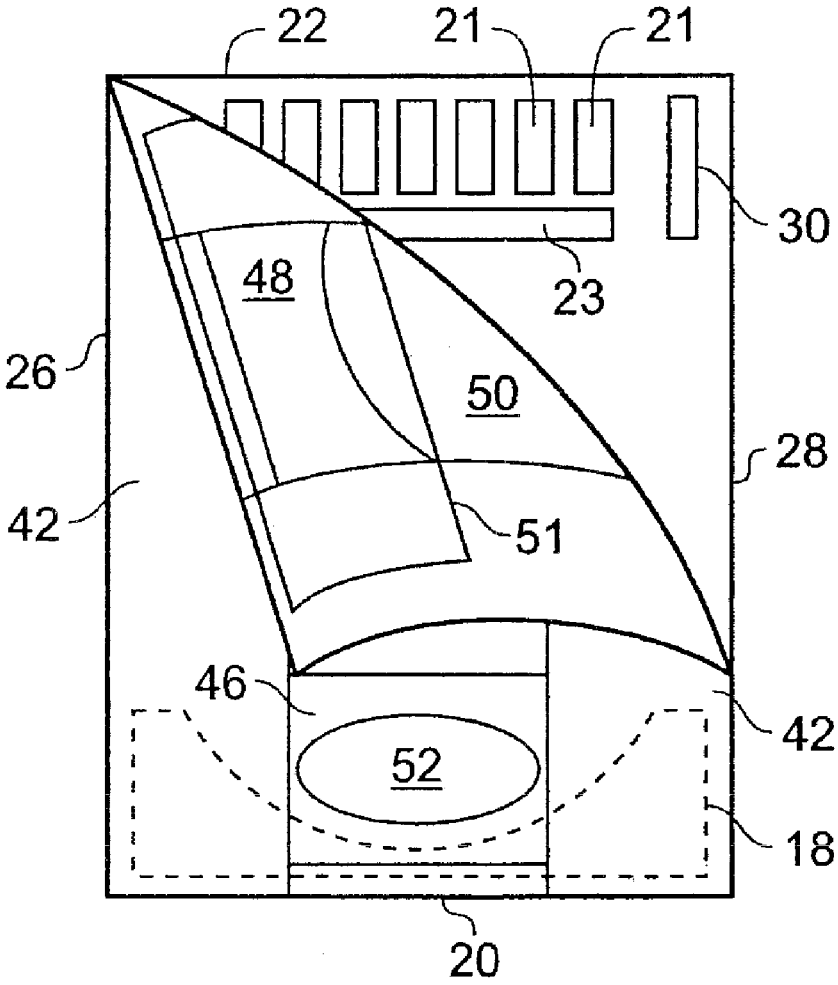
FIG. 3 is a part perspective view of a partially opened hairdresser's masking aid comprising rear and front panels of FIGS. 1 and 2 respectively.

Referring now to FIG. 3 which shows a hairdresser's masking aid comprising the front sheet of FIG. 2 and the rear sheet of FIG. 1. In the drawing of FIG. 3 the front panel is partially opened in that it has been detached from the adhesive strip 30 in the top right hand corner of the panel as shown, but not the left hand strip 30, and peeled back to show the masking aid in a partly opened configuration. The area of this rectangular silicone release layer 51 applied to the rear surface of the front sheet is partially revealed in this view of the masking aid. As previously mentioned the front sheet is secured to the rear sheet by the adhesive strip 18 to provide a bottom edge seal and define the hinge line 34 by which the respective panels may be hinged apart. As the front and rear panels are the same shape and size they are joined together by placing the front sheet over the rear sheet such that the reverse side of the front sheet, that is to say the other side that is showing from FIG. 2, is brought into contact with the adhesive 18. As the metal foil substrate strips 42 are laminated on the upward facing side of the plastics substrate, that is to say the outer side of the front sheet in the finished product, the adhesive 18 adheres to the plastics substrate only, not the foil substrate strips 42.

A silicone release layer 51 (as shown in FIG. 3) is printed on the reverse side of the front sheet in the region of the islands 21 to readily enable the separation of the front sheet in the region of the top edge 22 when the panels are opened and hinged apart. The silicone release layer does not cover the region on the reverse of the front sheet corresponding to the position of the adhesive strips 30 since these strips function to hold the front and rear panels together in the region of the top edge prior to use and also provide a degree of security when the panels are brought together to envelope the selected strands of hair in use.

As can best be seen in the drawing of FIG. 3 the bottom edge oval window 52 is shaped to correspond to the inverted arch of the adhesive strip 18, the latter of which is shaped to provide an excess product reservoir, or sump, for retaining excess treatment products or solution in the envelope in use. In this respect the inverted arch defines a gently sloping valley into which any excess treatment solution or product can run in to if too much treatment solution/product is applied by the hairdresser to the selected strands. The window 52 enables the hairdresser to monitor the extent of excess/product solution in the masking sheet once it has been closed.

Figure 4:
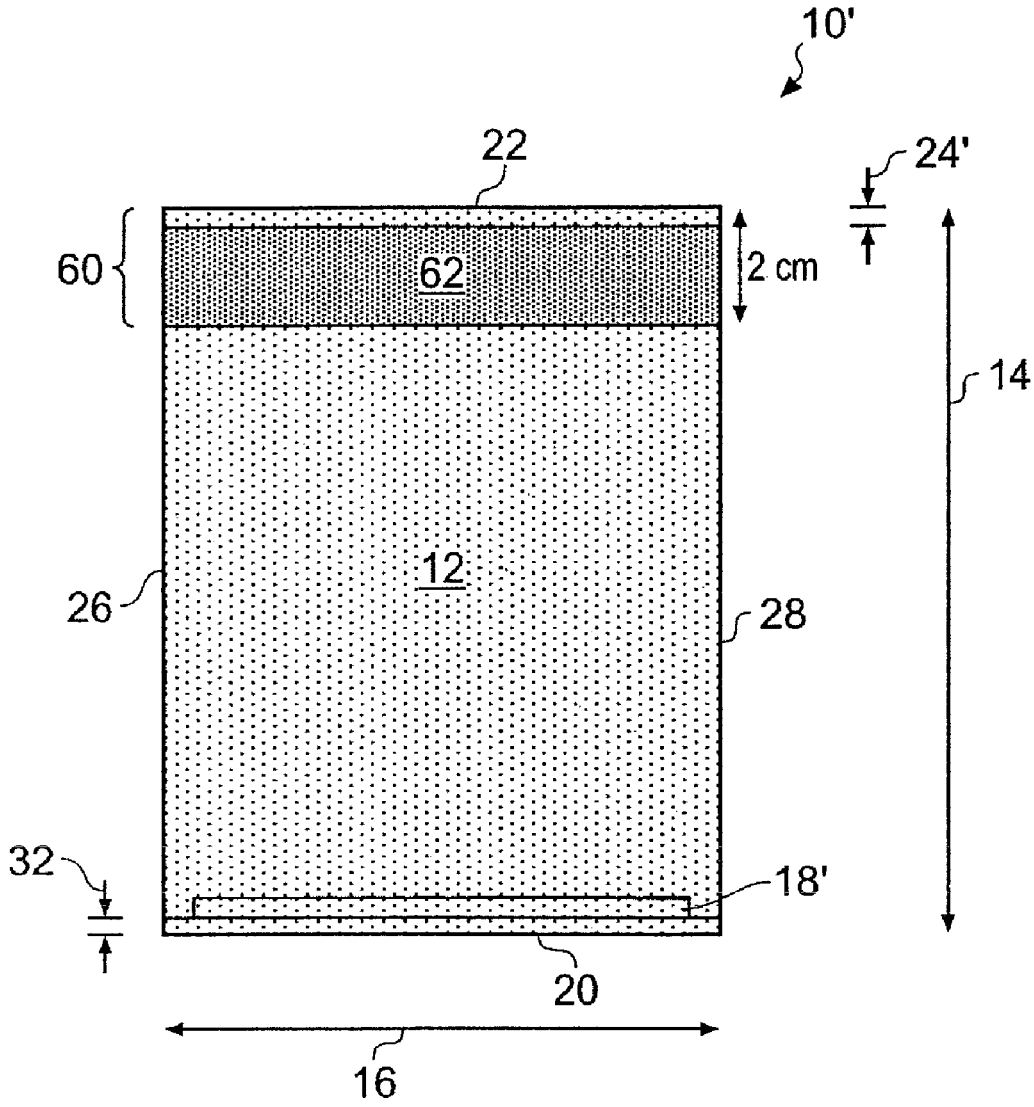
FIG. 4 is a plan view of a rear panel for a hairdresser's masking aid according to another embodiment of the present invention.

Referring to FIG. 4, a rear panel 10' according to a second embodiment of the invention comprises a rectangular sheet of aluminum foil having substantially the same overall dimensions as the rear panel 10 of FIG. 1, in this case the length dimension 14 is 120 mm and the width dimension 16 is 93 mm. In the embodiment of FIG. 4 the sheet comprises only one strip of adhesive 18' which is positioned in proximity to the lower edge 20 of the sheet. The rectangular spaced adhesive islands 23 and adhesive strips 30 of the sheet of FIG. 1 in the region of the upper edge 22 are not present in the embodiment of FIG. 4. The adhesive 18' is in the form of a rectangular strip and as in the embodiment of FIG. 1 a non-adhesive border region 32 having a width dimension of about 2-3 mm is provided between the strip 18, the lower edge 20 and the respective side edges 26 and 28.

The sheet 12 includes a folded top edge margin 60 where three layers of foil are folded over on top of themselves in the form of a Z-fold to provide a three-layer portion for increased stiffness along the top edge of the sheet. The top edge portion 60 has a depth dimension of 20 mm or so as measured from the top edge 22. The majority of the top edge portion 60, as identified by the rectangular area 62, is embossed. The embossed area 62 extends from one side of the sheet to the other and has a thickness dimension of 18 mm or thereabouts and is positioned about 2 mm or so from the top edge 22 as identified by the depth dimension gap 24'. The embossed region 62 may be embossed with any suitable pattern with provides for increases stiffness and/or flow of treatment solution as a result of capillary action in use. In this way the embossed pattern may be provided by a plurality of embossed parallel strips which extend in the longitudinal direction of the sheet perpendicular to the top edge 22 to provide a plurality of discrete liquid conducting channels for capillary flow of treatment solution in use.

The three layers of sheet material which comprise the Z-fold at the top edge of the sheet are preferably joined together by adhesive applied to the adjoining surfaces of the respective layers. It is to be understood that when the Z-fold is formed during the production process the web of foil material is preferably cut in such a way that it is cut along a cut line through the three-layer part of the Z-fold such that the region 60 at the top of the sheet comprises three layers of sheet material as well as the marginal region defined at the lower edge by the boundary 32. It is to be understood that this provides for ease of cutting the web of material into sheets since the cut line passes entirely through the multiple layer part of the sheet. In this way the cutter can be optimized for cutting a particular thickness of metal foil sheet.

Figure 5:
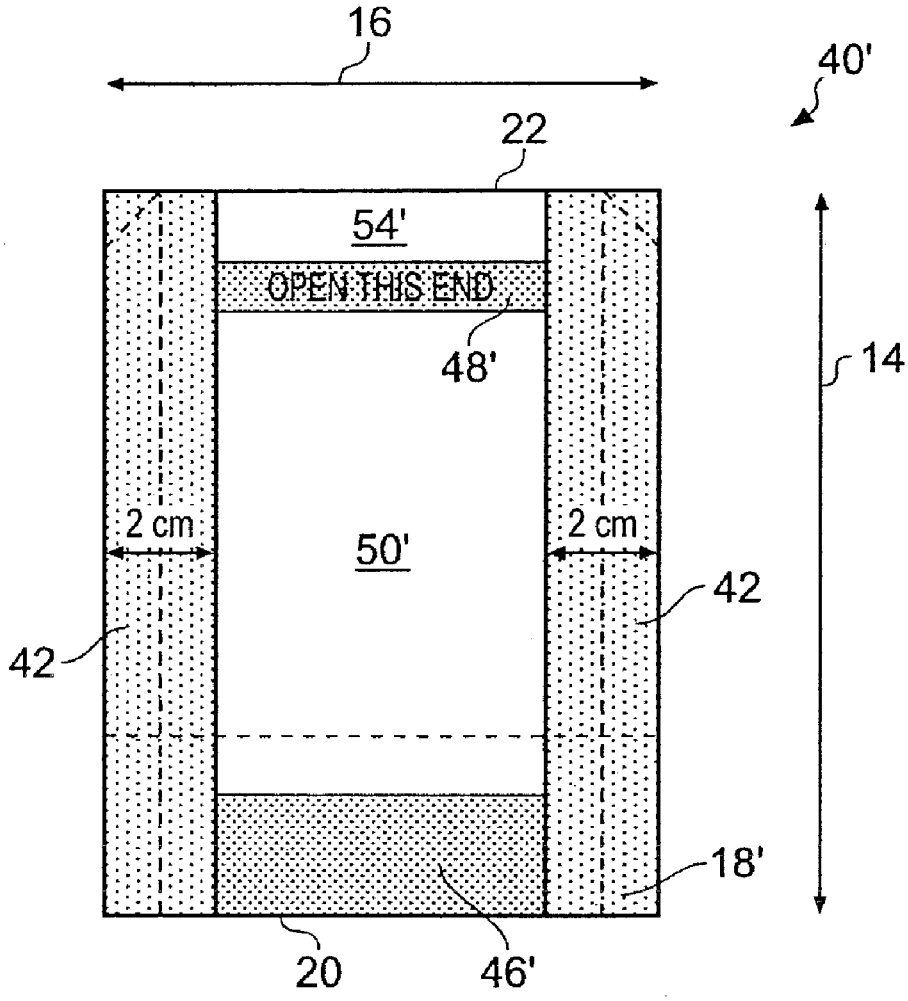
FIG. 5 is a plan view of a front panel for a masking aid having a rear panel as shown in FIG. 4.

Referring now to FIG. 5, the front panel 40' of the second embodiment is similar to the first in that it comprises a substrate of transparent flexible plastics material laminated over at least part of its area to a metal foil substrate by a laminating wax as previously described. The front sheet of the embodiment of FIG. 5 includes the following modifications over the front sheet 40 of FIG. 2. First of all the width dimension is the same as that of the rear panel of FIG. 4, namely 930 mm instead of 900 mm and the width of the metal foil strips 42 is 20 mm instead of 25 mm. The main window region 50' in the centre of the panel has a length dimension of approximately 80 mm between the rectangular shaped opaque regions 46' and 48' at the bottom and top edge regions of the sheet respectively. The opaque region 48' is in the shape of a rectangular strip which extends between both foil metal strips 42 and has a width, or depth dimension, of 10 mm or so which is spaced from the top edge 22 of the panel by 10 mm or so such that the top edge window 54' has a depth or width dimension of that same amount. The main window 50' is wider and deeper than the window 50 in the embodiment of FIG. 2 and the bottom edge window 52 of the embodiment of FIG. 2 is absent from the rectangular opaque block 46'. The opaque block 46' extends between the metal foil strips 42 and covers the region of the plastics substrate from the bottom edge 20 to the bottom part of the central window 50' having a width (or depth) dimension of 20 mm, that is to say the bottom edge of the central window 50' is spaced 20 mm from the bottom edge 20 of the sheet.

The surface of the front sheet shown in FIG. 5 is provided with a plurality of printed dashed lines which indicate respective fold lines for folding the masking aid formed from the front of FIG. 5 and FIG. 4 in use.

Figure 6:
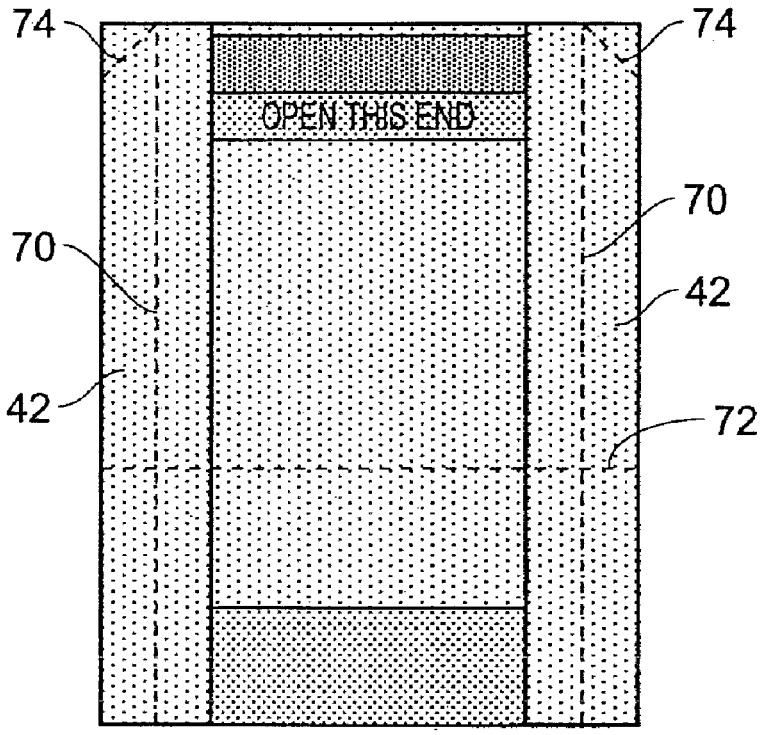
FIG. 6 is a further embodiment of a panel for a masking aid.

As previously described with reference to the first embodiment of FIGS. 1 to 3 the adhesive strip 18' is used to join the front and rear panels together to provide a bottom edge seal and joint about which the sheets maybe hinged apart. As there is no adhesive applied to the rear panel in the top edge region in this embodiment there is no requirement for a release layer on the rear of the front panel 40' and in the present embodiment. It will be understood that the upward facing surface of the front panel shown in FIG. 5 forms the front outward facing surface of the masking aid when the panels are joined together as shown in FIG. 6. The front surface of the rear panel shown in FIG. 4 lies adjacent the rear surface (not shown) of the front panel of FIG. 5. The masking aid envelope may be opened by pealing the front panel away from the rear panel in the region of the top edge 22 first. As can be seen in the drawing of FIG. 6 the top edge window 54' reveals part of the embossed region 62 and it will be understood that the region covered by the window 54' may contain visible indicia such as a brand name, logo or written information either printed on or being part of the embossed pattern.

Fold line indicia printed on the forward facing surface of the front panel include a pair of parallel fold lines 70 which extend along the length of the metal foil strips 42 between the top and bottom edge of the front panel. The fold lines 70 are positioned midway between the respective longitudinal side edges of the strips 42, that is to say 10 mm or so inwards from the sides 26 and 28 of the panel. A horizontal fold line 72 is printed on the front panel at a distance of 45 mm from the bottom edge 20. The fold line 72 extends from one side of the front panel to the other parallel with the top and bottom edges. A pair of inclined fold lines 74 are positioned at the upper left and right hand corners of the front panel and extend at an angle of 45 degrees or so from the point where the fold lines 70 reach the top edge 22 and slope downwards at that angle to the respective edges 26 and 28.

In use the front and rear panels are brought into proximity with each other to enclose the selected of strands of hair to be treated. In the case of applying highlights to the selected strands it is only necessary to fold the adjacent front and rear panels together along the fold lines 74 to hold the masking aid in place, since the ability of both the front and rear panels to produce a dead fold along the fold lines is sufficient to hold the masking aid on the head of hair being treated. In the case where colour is to be applied to the remaining hair outside of the masking aid envelopes it is also necessary to limit the overall dimensions of the respective masking envelopes by folding the envelope over itself along the fold line 72 and then to seal the envelope along its sides by folding the respective longitudinal edges over themselves along the fold lines 70.

It will be understood that the present invention also contemplates embodiments where the depth or length dimension 16 of the respective front and rear panels is different to that of the illustrated embodiment, in one example the depth dimension of the second embodiment shown in FIGS. 4 to 6 is 195 mm with respective horizontal fold lines at 90 mm and 45 mm from the bottom edge 20 in place of the horizontal fold line 72 shown in the drawing of FIG. 6.

Although the invention has been described with reference to the illustrated embodiment it is to be understood that various modifications and changes may be made to the illustrated embodiment without exercise of further inventive skill and effort. For example, the present invention also contemplates embodiments where the rear panel 10 comprises a substrate of a flexible plastics material, preferably but not necessarily transparent, laminated over at least part of its area to a metal foil substrate using a laminating wax. In one embodiment both the front and rear panel may comprise such a plastics and metal foil laminate material. The invention also contemplates embodiments where only the rear panel comprises such a laminate material. The invention also contemplates embodiments where the rear panel comprises a laminated panel comprising a substrate of flexible and transparent plastics material laminated along its side edges to a metal foil substrate, substantially in the same way as the front panel of FIG. 2 is configured. A masking aid comprising a front panel of the type illustrated in FIG. 2 and a similarly laminated rear panel has the advantage of providing transparent window areas on both of the front and rear of the masking aid so formed so that the selected strands of hair contained within the envelope can be viewed even if it is folded when attached to the hair in use as aluminum foil is folded to reduce the envelope size when attached to the hair in use.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

The invention claimed is:

1. A hairdresser's masking aid, for masking selected strands of hair from other strands of hair while the selected strands are treated, the masking aid comprising:

at least two panels of flexible sheet material which are capable of being hinged apart to receive the selected strands and subsequently brought together to envelop the selected strands, and at least one of the panels further comprising:

a substrate of a flexible and transparent plastics material laminated over at least part of its area to a metal foil substrate, said plastics substrate being laminated to the said metal foil substrate by a laminating wax;

said metal foil substrate is laminated to said plastic substrate at least along the lateral sides of said panel;

an elongate strip of said metal foil substrate is laminated to said plastic substrate along each of said lateral sides of the sheet;

the region between the said elongate strips comprises at least one transparent region;

said region between said elongate strips comprises at least one opaque or semi-opaque region; and said opaque or semi-opaque region(s) divide the non-laminated part of the sheet to provide a plurality of separate windows in the sheet.

2. A hairdresser's masking aid as claimed in claim 1, wherein:

said laminating wax comprises at least one of a mineral oil wax and a vegetable oil wax.

3. A hairdresser's masking aid as claimed in claim 1, wherein:

said laminating wax comprises a paraffin wax.

4. A hairdresser's masking aid as claimed in claim 1, wherein:

said elongate strips are arranged to lie parallel on said sheet.

5. A hairdressers masking aid as claimed in claim 1, wherein:

said opaque or semi-opaque region(s) extends between said elongate strips.

6. A hairdresser's masking aid as claimed claim 1, wherein:

said opaque or semi-opaque region(s) are printed on said plastics substrate.

7. A hairdresser's masking aid as claimed in claim 6, wherein:

said opaque or semi-opaque region(s) are printed on said plastics substrate using ink.

8. A hairdresser's masking aid as claimed in claim 1, wherein:

the metal foil substrate comprises aluminum foil.

9. A hairdresser's masking aid as claimed in claim 8, wherein:

the said metal foil substrate has a thickness in the range of 10-20 microns.

10. A hairdressers masking aid as claimed in claim 9, wherein:

said metal foil substrate has a thickness of 18 microns.

11. A hairdressers masking aid as claimed in claim 9, wherein:

said plastics substrate has a thickness of 12 microns.

12. A hairdressers masking aid as claimed in claim 1, wherein:

said plastics substrate is selected from the group comprising: PET, HDPE and polyester.

13. A hairdresser's masking aid as claimed in claim 1, wherein:

said plastics substrate has a thickness in the range of 10-20 microns.

14. A hairdresser's masking aid as claimed in claim 1, wherein:

said laminating wax has a print density of 0.6-2.2 grams per square meter.

15. A hairdresser's masking aid for masking selected strands of hair from other strands of hair while the selected strands are treated, the masking aid comprising:

at least two panels of flexible sheet material which are capable of being hinged apart to receive the selected strands and subsequently brought together to envelop the selected strands, and at least one of the panels further comprising:

a substrate of a flexible and transparent plastics material laminated over at least part of its area to a metal foil substrate, said plastics substrate being laminated to the said metal foil substrate by a laminating wax;

said at least one panel comprising laminated plastics and metal foil substrates comprises a front panel of said masking aid;

said front panel is joined to a rear panel of said masking aid;

said front and rear panels are joined together at one end of the respective panels to provide a bottom edge seal about which the panels may be hinged apart; and said bottom edge seal comprises an excess product reservoir for retaining excess treatment solution during a use.

16. A hairdresser's masking aid as claimed in claim 15, wherein:

said front and rear panels are joined by an adhesive.

17. A hairdresser's masking aid for masking selected strands of hair from other strands of hair while the selected strands are treated, the masking aid comprising:

at least two panels of flexible sheet material which are capable of being hinged apart to receive the selected strands and subsequently brought together to envelop the selected strands, and at least one of the panels further comprising:

a substrate of a flexible and transparent plastics material laminated over at least part of its area to a metal foil substrate, said plastics substrate being laminated to the said metal foil substrate by a laminating wax;

said at least one panel comprising laminated plastics and metal foil substrates comprises a front panel of said masking aid;

said front panel is joined to a rear panel of said masking aid;

said rear panel comprises a sheet of metal foil;

said rear panel comprises a top edge portion having a stiffness greater than substantially the remaining part of said rear panel; and said top edge portion comprises:

a stiffened multiple thickness portion, including at least one of a triple thickness portion and, a triple thickness portion provided by a Z-fold in the said metal foil material.

18. A hairdresser's masking aid as claimed in claim 17, wherein:

said rear panel comprises aluminum foil.

19. A hairdresser's masking aid as claimed in claim 17, wherein:

said rear panel metal foil has a thickness in the range of 12 to 24 microns.

20. A hairdresser's masking aid as claimed in claim 19, wherein:

said rear panel metal foil has a thickness between 18 and 20 microns.

21. A hairdresser's masking aid as claimed in claim 17, wherein:

at least part of said top edge portion is embossed.

22. A hairdresser's masking aid for masking selected strands of hair from other strands of hair while the selected strands are treated, the masking aid comprising:

at least two panels of flexible sheet material which are capable of being hinged apart to receive the selected strands and subsequently brought together to envelop the selected strands, and at least one of the panels further comprising:

a substrate of a flexible and transparent plastics material laminated over at least part of its area to a metal foil substrate, said plastics substrate being laminated to the said metal foil substrate by a laminating wax;

said at least one panel comprising laminated plastics and metal foil substrates comprises a front panel of said masking aid;

said front panel is joined to a rear panel of said masking aid;

said rear panel comprises a sheet of metal foil;

said rear panel comprises a top edge portion having a stiffness greater than substantially the remaining part of said rear panel at least part of said top edge portion is embossed; and said at least part of the top edge portion is embossed with a plurality of parallel lines.

23. A hairdresser's masking aid as claimed in claim 22, wherein:

said embossed parallel lines extend in a direction perpendicular to the top edge of said rear panel.

24. A hairdresser's masking aid for masking selected strands of hair from other strands of hair while the selected strands are treated, the masking aid comprising:

at least two panels of flexible sheet material which are capable of being hinged apart to receive the selected strands and subsequently brought together to envelop the selected strands, and at least one of the panels further comprising:

a substrate of a flexible and transparent plastics material laminated over at least part of its area to a metal foil substrate, said plastics substrate being laminated to the said metal foil substrate by a laminating wax;

said at least one panel comprising laminated plastics and metal foil substrates comprises a front panel of said masking aid;

said front panel is joined to a rear panel of said masking aid;

said rear panel comprises a sheet of metal foil;

said rear panel comprises a top edge portion having a stiffness greater than substantially the remaining part of said rear panel at least part of said top edge portion is embossed; and there is a non-embossed region between the embossed region and the top edge of said panel.

25. A hairdresser's masking aid as claimed in claim 24, wherein:

said non-embossed region has a depth of between 1.0 and 3.0 mm from the top edge of said panel and the embossed region extends away from the non-embossed region and has a depth dimension of 15-25 mm.

* * * * *